United States Patent [19]

Anderson

[11] 4,185,180

[45] Jan. 22, 1980

[54] VIBRATION SENSING DEVICE

[75] Inventor: Francis J. Anderson, Dublin, Ireland

[73] Assignee: Institute for Industrial Research & Standards, Dublin, Ireland

[21] Appl. No.: 919,519

[22] Filed: Jun. 27, 1978

[30] Foreign Application Priority Data

| | | | |
|---|---|---|---|
| Jun. 27, 1977 | [IE] | Ireland | 1306/77 |
| Jul. 29, 1977 | [IE] | Ireland | 1584/77 |
| Oct. 12, 1977 | [IE] | Ireland | 2086/77 |

[51] Int. Cl.[2] ..... H01H 35/14; G08B 13/00

[52] U.S. Cl. ..... 200/61.45 R; 200/61.52; 200/61.93; 200/277

[58] Field of Search ..... 200/61.45 R, 61.48-61.53, 200/277, 61.93, DIG. 45; 340/566, 683, 541, 545, 547, 565, 669, 670; 102/262, 272; 73/570, 632, 649, 651, 652

[56] References Cited

U.S. PATENT DOCUMENTS

| | | | |
|---|---|---|---|
| 2,721,611 | 10/1955 | Gordon | 200/61.52 X |
| 2,996,586 | 8/1961 | Shindledecker et al. | 200/61.49 X |
| 3,161,737 | 12/1964 | Hall | 200/61.52 |
| 3,161,738 | 12/1964 | Hall | 200/61.52 |
| 3,295,101 | 12/1966 | Ellis | 200/61.45 R X |
| 3,486,143 | 12/1969 | Wilkes | 200/DIG. 45 |
| 3,696,380 | 10/1972 | Murphy | 200/61.93 |
| 4,025,744 | 5/1977 | Kniskern | 200/61.45 R |
| 4,085,304 | 4/1978 | Hasler | 200/61.45 R |

FOREIGN PATENT DOCUMENTS

| | | | |
|---|---|---|---|
| 2423660 | 12/1974 | Fed. Rep. of Germany | 200/277 |
| 776878 | 11/1934 | France | 200/61.45 R |

OTHER PUBLICATIONS

Wilkes, D. F.; "Rolamite: A New Mechanical Design Concept"; Sandia Laboratories, Mar. 1969; No. SC-R-R-67-656B, pp. 59-61.

*Primary Examiner*—James R. Scott

*Attorney, Agent, or Firm*—Ladas, Parry, Von Gehr, Goldsmith & Deschamps

[57] ABSTRACT

The invention provides a vibration sensing device which is used in safety and security equipment. The device is effectively an electrical switch and includes a pair of spaced apart electrically conductive plates each having an annular track formed by a hole. An electrically conductive bar is mounted between the plates on the tracks. On sensing a vibration the bar will resonate lifting off the tracks thus making and breaking the electrical circuit between the plates.

16 Claims, 25 Drawing Figures

XXI
XXI

XVIII
XVIII
XVIII
XVIII

VIBRATION SENSING DEVICE

BACKGROUND OF THE INVENTION

Introduction

The present invention relates to a vibration sensing device and in particular to a vibration sensing device of the type comprising an electrically conductive member supported normally on a seating formed from at least two spaced elements which spaced elements form electrical contacts.

Field of the Invention

Vibration sensing devices, often called inertia sensing devices or accelerometers are now used extensively for many operations. For example, they are used for security equipment and for safety equipment. These vibration sensing devices are switches operated by movement of the switch as a whole under the influence of an accelerating force, for example, any vibration, impact or other accelerating force.

Further, such vibration sensing devices are particularly useful for mounting on domestic applicances, such as, for example, washing machines and spin dryers so that when such machines exceed the pre-determined amplitude of oscillation due to over or eccentric loading of the drum the vibration sensing device can be used as a switch to cut off the supply of electricity. Similarly such vibration sensing devices may be used to disconnect the electrical system of vehicle, for example, in the event of a crash or can be used as a security device in the event of unauthorised interference with the vehicle.

The major requirement of such vibration of sensing devices is that they be inherently frequency sensitive and they exhibit sufficient sensitivity to vibration when set for low frequency values. It is also essential that these devices possess the additional property of mode conversion whereby whatever axis is excited by vibration the vibration becomes re-oriented along the sensitive direction of the device.

When using such a vibration sensing device in a security system it is necessary that the vibration sensing device rejects slow movements within a building structure caused by natural phenomena such as will be created by passing traffic, enviromental conditions such as storms, or birds flying against a window or fence. At the same time the vibration sensing equipment must be so arranged as to be extremely sensitive to high frequency or rapid movements, (acceleration) generated by forced intrusion or the breakdown of the structure. Thus the vibration sensing equipment must be connected to a suitable analysing unit which can measure the energy content together with the frequency of the pulses being transmitted. The vibration sensing device must be so arranged as to be extremely sensitive to high and low frequency energy transmitted through material such as glass, wood and metal. Thus, the vibration sensing device must react to vibration such as is generated by a high speed drill or glass cutter which combines high frequency with low energy and such as is generated by a hammer and chisel which combines low frequency with high energy. It is essential that such vibration sensing equipment be used not only to detect would-be intruders but also to reduce the risk of vandalism, damage to property, loss of goods and equipment and must be suitable for mounting on perimeter fences, building structures such as walls or rooms at entry points including windows, doors and ventilator grills.

Briefly, such vibration sensing devices when used in a security system consist primarily of two elements, a detecting loop namely, the sensor or vibrating sensing device and an analysing circuit. British Patent Specification No. 1,263,076 describes a vibration sensing device comprising an electrically conductive sphere supported normally on a seat formed by three pins or legs, two of the pins or legs forming electrical contacts such that upon dislodgement of the sphere off the seat upon vibration of the switch a circuit between the two contacts is momentarily broken. This switch may be used in conjunction with an analysing circuit such as described in British Patent Specification No. 1,441,563.

Further, British Patent Specification No. 1,145,204 describes a vibration sensing device comprising a housing defining a seating, a magnet positioned adjacent the seating and an operating mass of magnetic material adapted to be held on the seating by the attraction of the magnet until dislodged by an acceleration of such force applied to the vibration of sensing device as to overcome the magnet attraction thereby causing the mass to move an elongated member axially to make or break a pair of electrical contacts. Again, the operating mass is a sphere and the seating is frusto-conical.

In U.S. Pat. No. 2,622,163 there is described an electrical crash-operated sensing device for installation in an aircraft comprising a first annular member and a second annular member normally centralised within the annular member. The two members are mutually magnetically attractive, one thereof being fixed and the other being formed as a weight mass and having a support arranged to permit its approach to the fixed member under the influence of acceleration. Springs are connected to the movable member of an effective strength with relation to the distribution of the magnetic flux to resist such approach with the force such that an acceleration of a critical value or greater is required to effect contact of the said members. Similarly, U.S. Pat. No. 2,996,586 describes a vibration sensing device comprising a casing, a pair of magnets supported in the casing in spaced relationship with oppositely sided portions thereof facing each other, a pair of spaced apart contacts interposed between said magnets, each of said contacts having an opening therein and a rod extending to said openings and in contact with one of said portions. Vibration causes the rod to make contact with the other portion and close a circuit. Known vibration sensing devices are costly to manufacture and in general have not been widely used, for example, in domestic appliances since their provision would necessitate a disproportionate increase in the retail price of the appliance. Similarly, they are rather expensive to produce for security equipment. A problem with known vibration sensing devices of a type incorporating a sphere mounted on contacts is that the contact surface is relatively small thus leading, in use, to wear. Further, it is necessary to ensure that arcing does not affect the contact surfaces.

A further disadvantage with the vibration sensing devices heretofore known is that they can only be placed in certain orientations relative to the surface on which they are placed. For example, the sensing device of British Patent Specification No. 1,263,076 can only be arranged with the pins vertical and accordingly it must either be provided with an adjustable mounting plate or some other means whereby it can be positioned accurately. Such vibration sensing devices are particularly sensitive to variations in the mounting arrangement. A further problem with vibration sensing devices incorporating a magnet is that they can be readily easily tampered with since the placing of a magnet adjacent the device will tend to prevent the device operating.

Additionally, it has been found that vibration sensing devices of the type incorporating a sphere whether magnetically damped or not have considerable difficulty in differentiating between the vibration caused by discrete knocks or blows on a structure and the vibration caused by the breakdown of the structure. Thus these vibration sensing devices often give false alarms and if the analysing circuit is so arranged as to prevent false alarms there is a considerable risk that unauthorised entry may be made to a premises without an alarm condition being indicated.

An additional problem with known vibration sensing devices is that it is relatively difficult to alter the response of the device, that is to say, its natural response. For example, the response of the vibration sensing device of British Patent Specification No. 1,263,076 may be altered only by using magnetic damping or charging the spacing of the pins forming the seating of replacing the sphere with one of a different weight.

One of the major problems with vibration sensing devices as known heretofore is that they have to be manufactured to a fairly high degree of tolerance which increases the manufacturing costs.

Objects

The present invention is directed towards providing a vibration sensing device which will be more efficient in use than those heretofore produced.

Another object of the invention is to provide a vibration sensing device that is particularly suitable for frequency detection.

A further object of the invention is to provide a vibration sensing device that can be mounted on any surface without the necessity for alterations to the device.

Still another object of the invention is to produce a vibration sensing device that may be readily easily manufactured.

A still further object of the present invention is to produce a vibration sensing device the sensitivity of which can be readily altered.

An additional object of the present invention is to produce a vibration sensing device that will be particularly adapted to distinguishing between the various types of vibrations experienced by a structure.

SUMMARY OF THE INVENTION

This invention provides a vibration sensing device comprising a base support member; a pair of spaced apart electrically conductive plates mounted on the base support member; an annular track formed in each plate by a hole symmetrical about its central axis; and and elongated electrically conductive bar, symmetrical in cross-section, mounted between the plates on the annular tracks, the cross-sectional area of the bar relative to the area of the hole being such as to permit movement of the bar off the annular track on vibration of the device.

The above and other objects and advantages of this invention will become apparent from the following detailed description in connection with the accompanying drawings.

DETAILED DESCRIPTION OF INVENTION

Figure 1:
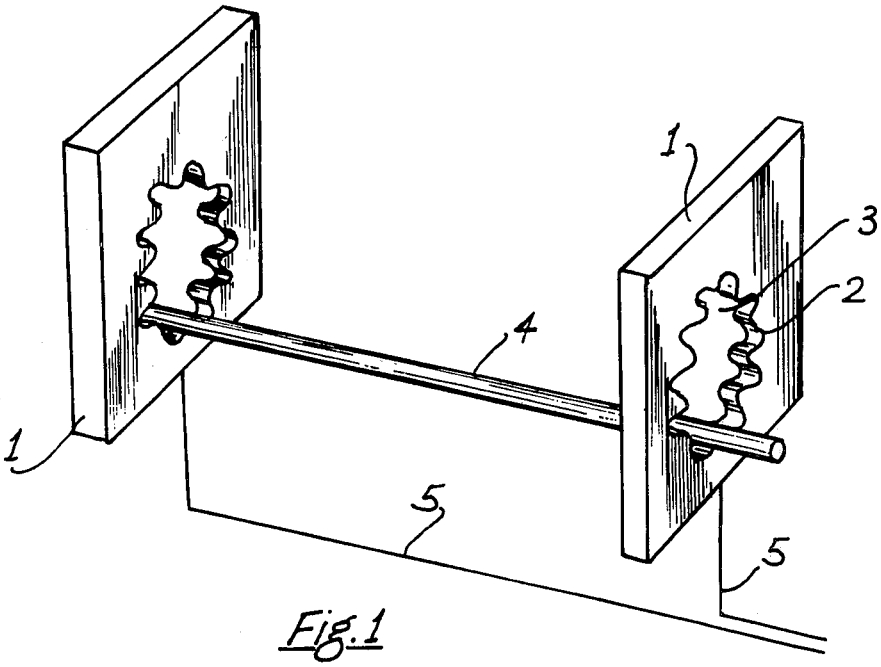
FIG. 1 is a perspective diagrammatic view of a vibration sensing device, according to the invention.
Figure 2:
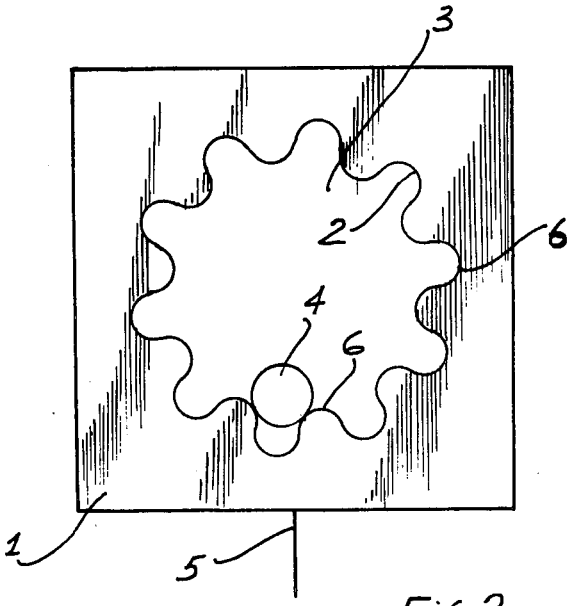
FIG. 2 is an end view of the vibration sensing device of FIG. 1, FIGS. *3a* to *3g* illustrate diagrammatically the various ways in which the vibration sensing device may be mounted.
Figure 3A:
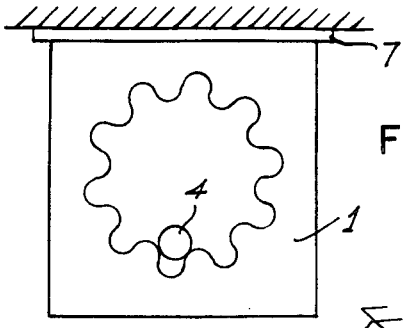
Figure 3B:
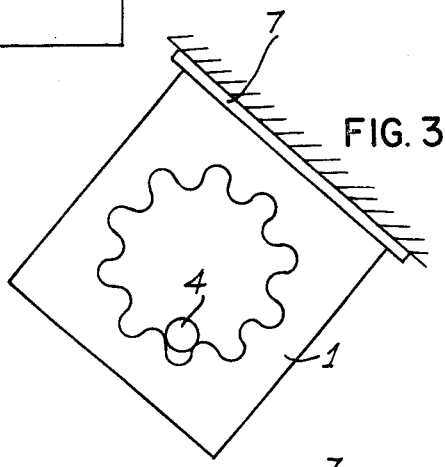
Figure 3G:
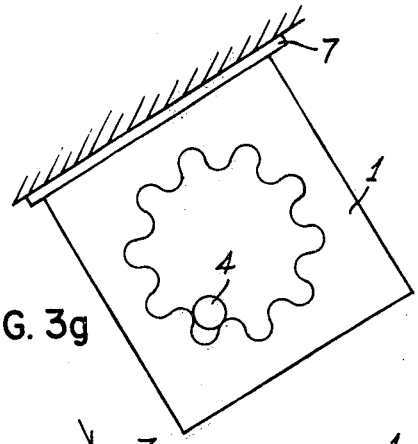
Figure 3F:
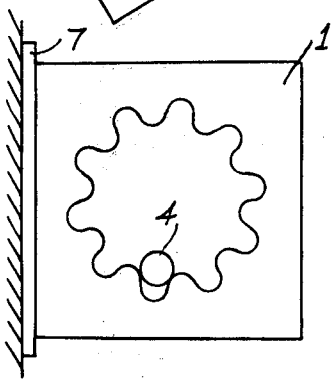
Figure 3C:
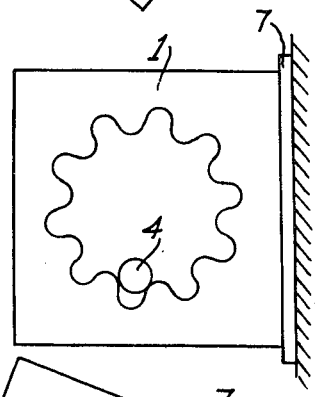
Figure 3E:
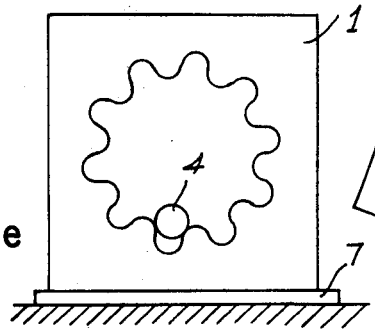
Figure 3D:
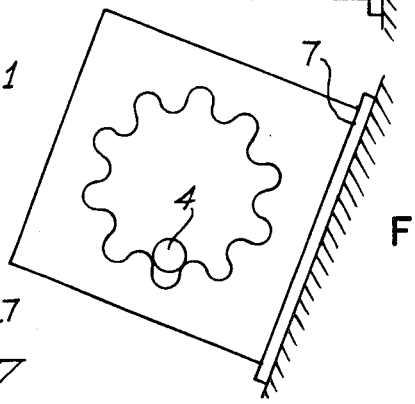

Referring to the drawings and initially to FIGS. 1 and 2 thereof there is provided a vibration sensing device including a pair of spaced apart electrically conductive plates 1 mounted on a suitable framework or base, and within a casing (not shown) in this drawing. Each plate 1 has an annular track 2 formed by a hole 3 symmetrical about its central axis. Mounted between the plates 1 is an elongated electrically conductive bar 4.

The plates 1 and bar 4 are preferably gold-plated brass and are connected by electrical wires 5 to a suitable analysing unit (not shown). It will be noted that the bar 4 is rotationally symmetrical, as it is in this embodiment a round bar. The annular track 2 has a number of circumferentially offset and equispaced supports for the bar 4, the spacing between two adjacent supports 6 being less than the diameter of the bar 4. The construction of the bar 4 and plates 1 are so arranged so that the bar will resonate when vibrations of the order of 10 Hz to 1500 Hz are detected.

It will be understood that in operation a normally closed circuit is provided by the plates 1 and bar 4. On disturbance of the bar 4 the normally closed circuit is broken and the bar 4 rises off the support 6 to deliver electrical pulses to the analysing unit.

Referring to FIG. 3 it will be seen that when the plates 1 are mounted on a base 7, that the vibration sensing device can be arranged on any type of surface without the necessity to provide a custom built or adjustable support. For example the vibration sensing device may be mounted directly below a surface as shown in FIGS. 3 (*a*) or immediately above it as shown in FIG. 3(*e*) or in many alternative arrangements such as on vertical surfaces as shown in FIGS. 3 (*c*) and 3 (*f*) or on an inclined surface as shown in FIGS. 3 (*b*) 3 (*d*) and 3 (*g*).

Referring to FIGS. 4 to 10 inclusive, parts similar to those described already are identified by the same reference numerals.

Figures 4, 5, 6, 7, 8, 9, 10, 11, 12, 13, 20, 21:
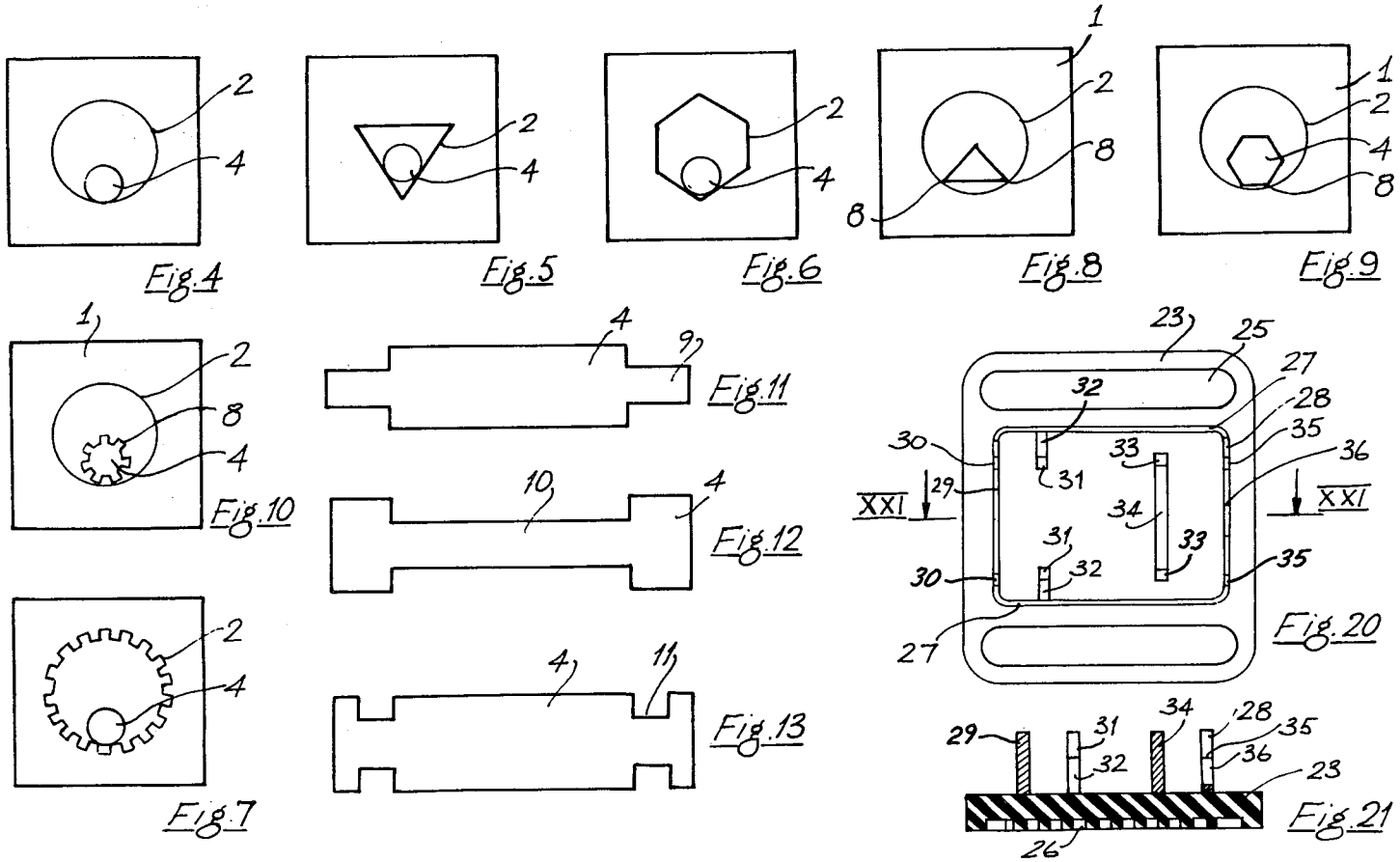
FIG. 4 is an end view similar to FIG. 2 of an alternative construction of vibration sensing device.
FIG. 5 is an end view similar to FIG. 2 of a further alternative construction of vibration sensing device.
FIG. 6 is an end view similar to FIG. 2 of a still further alternative construction of vibration sensing device.
FIG. 7 is an end view similar to FIG. 2 of another alternative embodiment of the invention.
FIG. 8 is an end view similar to FIG. 2 of another construction of vibration sensing device according to the invention.
FIG. 9 is an end view similar to FIG. 2 of a still further construction of vibration sensing device according to the invention.
FIG. 10 is an end view similar to FIG. 2 of another alternative construction of vibration sensing device according to the present invention.
FIG. 11 is a side view of a bar used in a vibration sensing device according to the invention.
FIG. 12 is a side view of another construction of bar used in the vibration sensing device according to the invention.
FIG. 13 is a side view of a still further construction of bar used in the vibration sensing device according to the present invention.
FIG. 20 is a plan view of portion of the vibration sensing device.
FIG. 21 is a cross-sectional view in the direction of the arrows XXI—XXI of FIG. 20

In FIG. 4 is shown the simpliest arrangement of vibration sensing device according to the present invention, in which the annular track 2 is a circular hole and the bar 4 is a round bar.

In FIG. 5 there is illustrated an annular track which is formed from a hole being regular polygon of triangular shape, while FIG. 6 shows a hexagonal track. FIG. 6 shows an annular track substantially similar to a splined hole.

In FIGS. 8,9 and 10 there is illustrated alternative arrangements of the vibration sensing device in which the annular track 2 is a circular hole and each bar 4 has formed thereon at least three substantially equispaced outwardly directed and circumferentially offset supports 8. In FIG. 8 these supports 8 are formed by the apexes of a triangle while FIG. 9 illustrates that the bar 4 may be a regular polygon in cross-section while FIG. 10 illustrates that the bar may be similar to a splined shaft, the splines forming the supports 8.

Preferably when the bar is round the outermost portion of each support is of arcuate shape and this provides a good contact. Similarly when the annular track is circular it is preferable that the free-end of each support is arcuate in cross-section.

Referring to FIGS. 11, 12 and 13, there is illustrated three alternative constructions of bar 4, for use with the embodiments of FIG. 1 to 7 inclusive, in which the diameter of the bar where it contacts the annular track is less than its diameter on at least one side of the plate 1. In FIG. 11 the bar 4 is provided with two ends 9, whose diameter is less than the rest of the bar for engaging the annular track 2. In FIG. 12 the interior of the bar 4 at 10 has a diameter less than that of the outer ends, while in the embodiment of FIG. 13, the bar 4 is provided with recesses 11 for engagement with the annular track 2 . There are certain advantages in using this construction bar in that the sensitivity of the vibration sensing device may be easily varied. It will be appreciated that the diameter of that portion of the bar engaging the annular track, will control the sensitivity of the device. For example, the smaller the diameter of the annular track engaging portion of the bar, the higher the frequency that must be sensed before the bar will vibrate or resonate. Similarly if the diameter of the annular track engaging portion is held constant and the weight of the bar is increased then the sensitivity of the device will be lowered. In other words it will require a greater amplitude of vibration at or above the predetermined frequency to cause the bar to vibrate sufficiently to break the circuit. Thus without altering the basic construction of the device it is possible to use rollers of many constructions. Further, the bar need only be machined to a high tolerance at the bar engaging portions thus reducing the cost of the construction of the device. It will be appreciated that substantially the same modifications may be made to the bars for use with the embodiments described with reference to FIGS. 8 to 10 inclusive.

Figures 14, 15, 16, 17, 18, 19, 22:
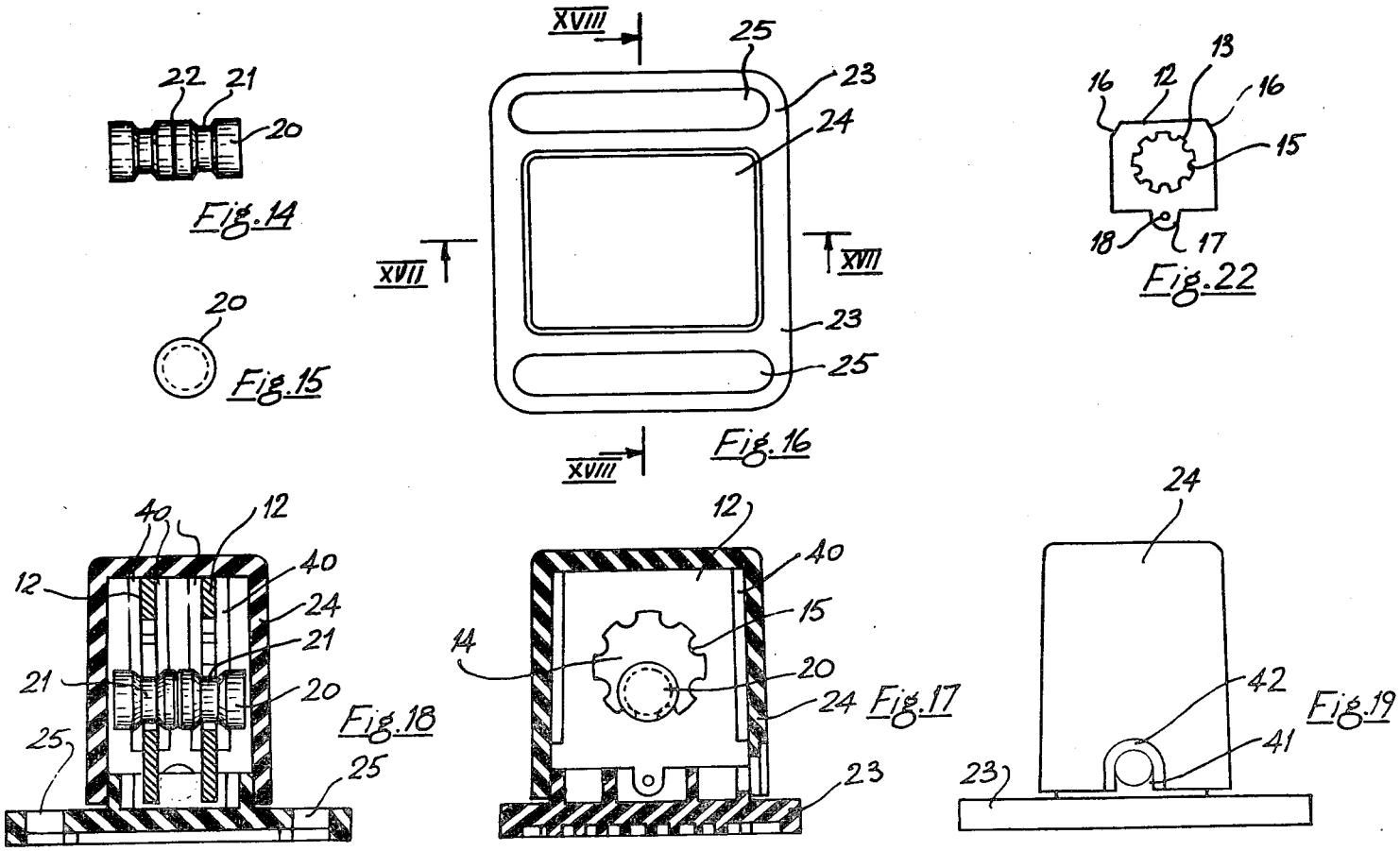
FIG. 14 is a side view of a bar in a vibration sensing device according to the invention.
FIG. 15 is an end view of the bar of FIG. 14.
FIG. 16 is a plan view of the vibrating sensing device according to the invention.
FIG. 17 is a cross-sectional view in the direction of the arrows XVII—XVII of FIG. 16.
FIG. 18 is a cross-sectional view in the direction of the arrows XVIII—XVIII of FIG. 16.
FIG. 19 is an end view elevation of the vibration sensing device.
FIG. 22 is a plan view of a plate used with the vibration sensing device of FIGS. 14 to 21 inclusive.

Referring to FIGS. 14 to 22 there is illustrated an actual construction of vibration sensing device according to the invention. Referring initially to FIGS. 14 to 15, there is illustrated a bar 20 manufactured from a suitable non-magnetic material namely gold-plated brass. The bar 20 is recessed to form two support engaging portions 21. A small groove 22 is cut centrally in the bar 20 and facilitates the suspension of the roller 20 on a wire when it is being gold-plated. It will be appreciated that it is necessary to support the roller when it is being gold-plated and to agitate it in a plating patch. By the provision of the groove 22 it is possible to use relatively small gauge wire which can be wrapped loosely around the bar 20. In this way the gold tends to penetrate beneath the wire and to gold plate the whole of the bar 20. If any portion of the bar 20 is not plated then since that portion is within the groove 22, it is relatively unimportant.

Referring to FIG. 22 two electrically conductive plates 12, similar to those described already, are provided each having an annular track 3 formed from a hole 4, and having a plurality of circumferentially offset and equispaced supports 15. The plate 12 is chamfered at 16, for ease of mounting as will be described hereinafter and is provided with an extension tab 17, having a hole 18 for reception of an electrical wire. The vibration sensing device is mounted on a base plate 23 and within a cover 24. The base plate 23 is provided with a pair of elongated slots 25 (see FIGS. 20 and 21) for reception of mounting bolts. The base plate 23 is provided with grooves 26 on its lower surface which grooves may accommodate for example a magnetic reed switch or alternatively it may be used to accommodate adhesive to secure the base plate 23 to a mounting surface. The upper surface of the base plate 23 is provided with a rectangular peripheral lip formed from a pair of side walls 27 and end walls 28 and 29. The end wall 29 is provided with a pair of grooves 30 for the electrically conductive plates 12 and will be described hereinafter. The grooves 30 are aligned with cut out ledges 31 on support walls 32, which project from the side walls 27. The grooves 30 are also aligned with further cut out ledges 33 on a central support wall 34. The end wall 28 has ledges 35, also aligned with the grooves 30, and lips 31 and 35. A substantially U-shaped groove 36, for reception of a cable, is provided in the end wall 28 between the ledges 35.

Each cover 24 is of substantially open box like construction having two sets of inwardly projecting rails 40 for reception of the plates 12. The cover 24 is provided with a U shaped slot 41, and an exterior U-shaped shoulder 42. The U-shaped slot 41 is adapted to coincide with the groove 36, to provide a hole for an electrical wire. This can be seen in FIG. 19.

To assemble the vibration sensing device, the plates 12 are laid on the base plate 23 engaging the grooves 30 and lips 31, 33 and 35. The electrical connections are led out through the groove 36 and U-shaped slot 41. The bar 20 is laid in position and the cover 23 is placed over the plates 12, the rails 40 securing the plate 12 in position. The cover 24 is secured to the base plate 23 and sealing compound is used in the U-shaped shoulder 42, to seal the casing. The vibration sensing device may incorporate a reed switch as indicated already. When this is the case then two extra electrical connections will have to be used and are preferably led through the base plate 23 to the reed switch which may be mounted in one of the grooves 26. The advantage of the use of a reed switch or any other type of magnetic contact is that it can be used to protect a structure with an opening for example, a door or window. The reed switch will detect the opening of the unlocked door or window while the vibration sensing device will detect an intruder forcing an entry through the structure.

As has been stated already it is preferable to use a frequency rather than an amplitude detection system in the measurement and sensing of vibrations. The main advantage of a frequency detection system over an amplitude system is that when a structure is subject to a series of discrete impacts or alternatively, a basic breakdown of the structure where amplitude detection is used there will be no distinction between the two cases. However, a frequency measurement will immediately detect the breakdown of the structure.

As explained already there are certain inherent disadvantages in the present construction of vibration sensing devices which include a conductive sphere normally supported on a seat formed by three pins, legs or other supports. It has now been found that the vibration sensing device according to the present invention is considerably more sensitive to the measurement of frequency than a security sensing device incorporating a ball or sphere.

It is not known exactly why this is so but it is suggested that possibly the reasons are firstly, that the roller according to the present invention is constrained to drop more quickly than the ball or sphere and hence it tends to meet the seating again as the seating is still vibrating. Secondly, the roller will react differently to offset loading. Thirdly, it is believed that the roller will tend to pivot about its mid point between two supports and not just simply up and down, therefore, there will be a certain rocking motion which will lead to the detection of further vibrations. This is, as suggested may partly be brought about by the fact that the roller does not completely orient itself as a sphere does. Whether this explanation is or is not correct and it is merely given to assist the reader. It has been found that there is a considerable difference in the response between the vibration sensing device according to the present invention and a more conventional sensing device incorporating a sphere. Before referring to FIGS. 23 to 25 it should be noted that the test results are not entirely accurate as the recording instrument used incorporated a pen and the pen probably did not necessarily react sufficiently quickly to the various frequency vibrations sensed.

Figure 23:
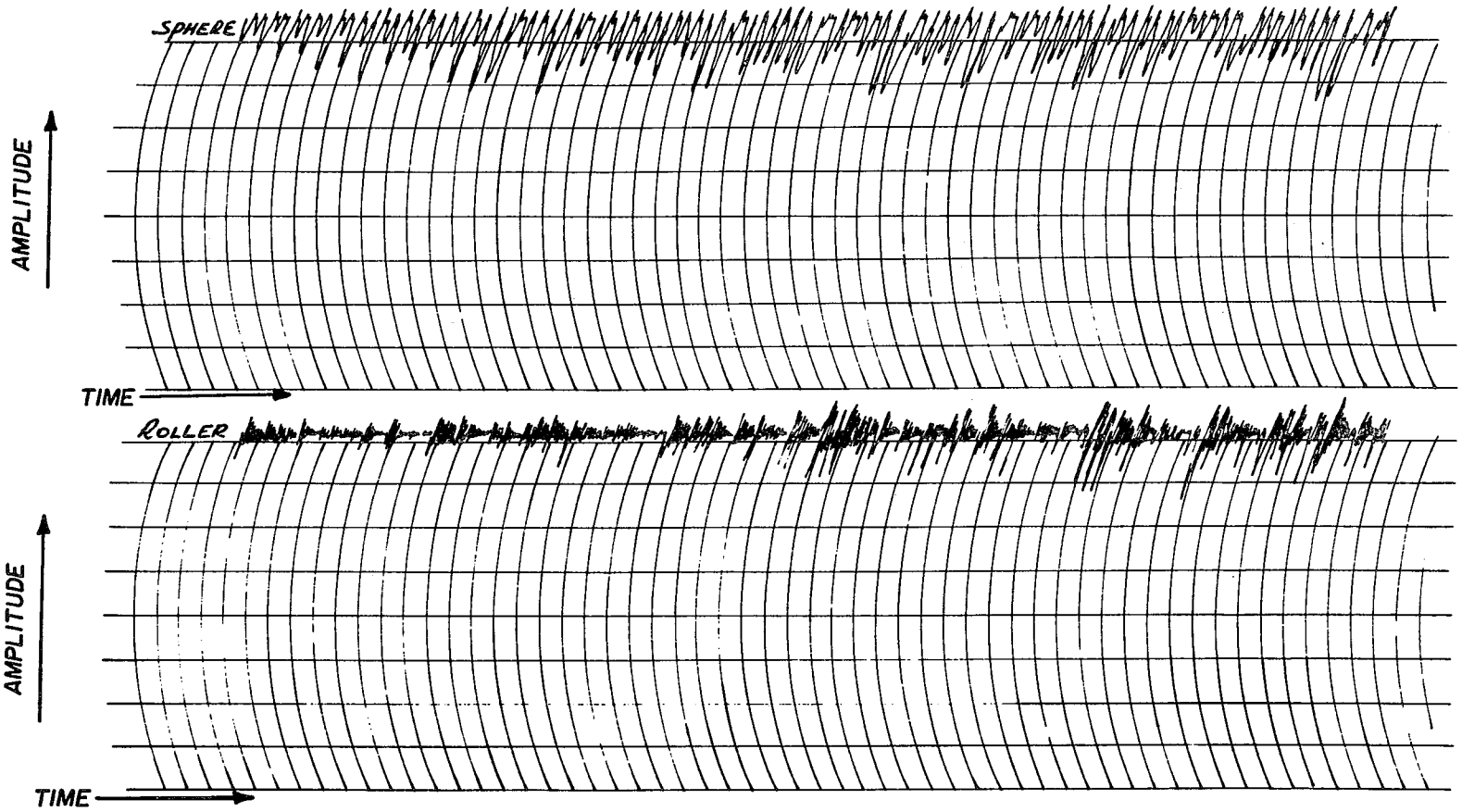
FIGS. 23 to 25 are test results showing the response of a conventional sphere type vibration sensing device and a sensing device according to the invention.

Referring to FIG. 23 a vibration of 10 Hz was imparted to a piece of wood midway between a vibration sensing device according to the present invention and the vibration sensing device of the sphere type. It must be appreciated that this is not to say that the structure vibrated at 10 Hz but merely that 10 Hz was imparted to the structure. It will be noted that the frequency response of the roller is considerably greater than that of the sphere.

Figure 24:
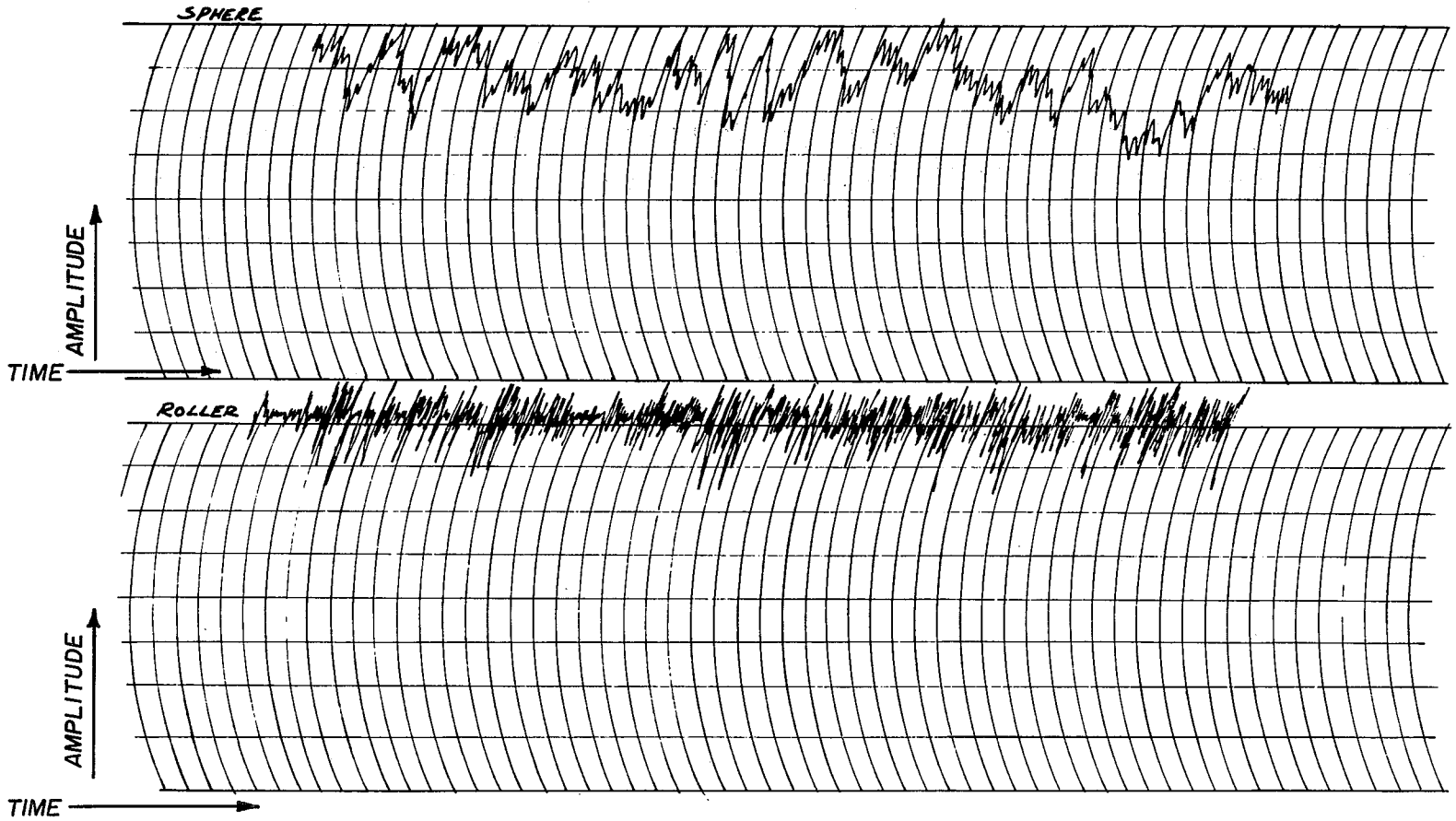

FIG. 24 shows a similar test where a vibration of 30 Hz was imparted to the piece of wood. It is estimated that the results of the test are not strictly correct as the roller was vibrating so rapidly that the recording instrument was unable to respond sufficiently quickly.

Figure 25:
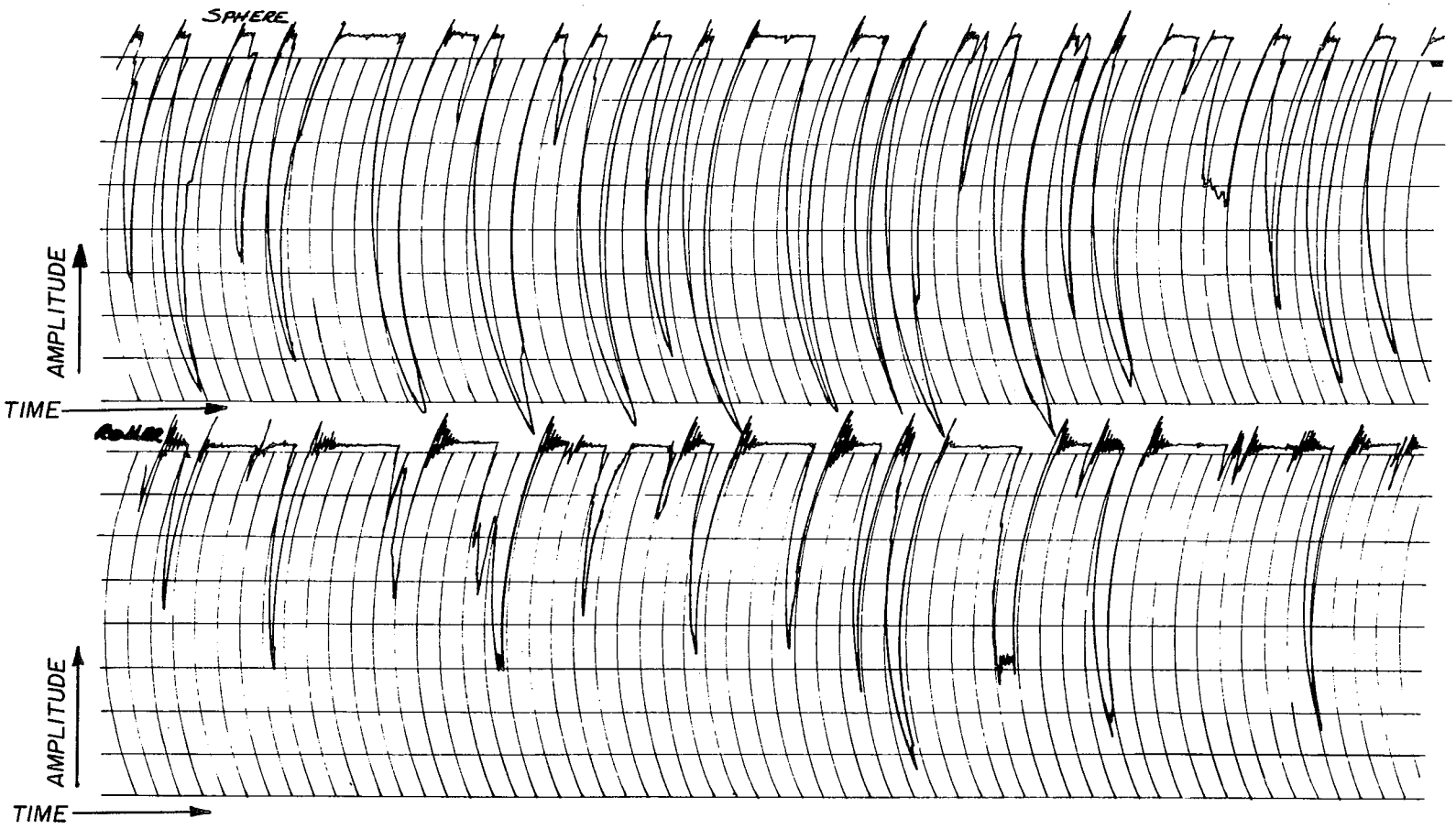

Referring to FIG. 25 there is illustrated the response of the two vibrating sensing devices when the wood was sawed. It is quite noticable that the disintegration of the structure was sensed by the high frequency response of the roller.

I claim:

1. A vibration sensing device comprising:
a non-conductive base support member;
a pair of spaced apart electrically conductive plates upstanding from the base support member and electrically insulated from each other;
an annular track formed in each plate by a hole symmetrical about its central axis; and
a single elongated electrically conductive bar, symmetrical in cross-section mounted between the plates on the annular tracks, the cross-sectional area of the bar relative to the area of the hole being such as to permit movement of the bar off the annular tracks on vibration of the device, the said bar and annular tracks forming part of an electrical circuit.

2. A vibration sensing device as recited in claim 1 in which the diameter of the bar where it contacts the annular track is less than its diameter on at least one side of the plate.

3. A vibration sensing device as recited in claim 1 in which the bar has two spaced apart recesses of reduced diameter where it engages the annular tracks.

4. A vibration sensing device as recited in claim 1 in which the vibration sensing device is mounted in a casing which incorporates the base support member, the base support member incorporating a magnetic reed switch, so that the reed switch senses relative movement of an adjacent magnet.

5. A vibration sensing device as recited in claim 1 in which each annular track is formed by a polygonal hole, adjacent sides of the hole forming spaced apart support surfaces for the bar.

6. A vibration sensing device as recited in claim 1 in which each annular track has a plurality of circumferentially offset and equispaced inwardly directed supports for the bar, the spacing between two adjacent supports being less than the diameter of the bar where it contacts a track.

7. A vibration sensing device as recited in claim 6 in which each support forms an arc of a circle and a portion of the track between supports forms an arc of a further circle with its centre coincident with the hole central axis.

8. A vibration sensing device as recited in claim 6 in which the diameter of the bar where it contacts the annular track is less than its diameter on at least one side of the plate.

9. A vibration sensing device as recited in claim 6 in which the bar has two spaced apart recesses of reduced diameter where it engages the annular tracks.

10. A vibration sensing device as recited in claim 6 in which the vibration sensing device is mounted in a casing which incorporates the base support member, the base support member incorporating a magnetic reed switch, so that the reed switch senses relative movement of an adjacent magnet.

11. A vibration sensing device as recited in claim 1 in which each annular track is formed by a round hole and the bar has formed thereon at least three substantially equi-spaced outwardly directed and circumferentially offset supports to engage the annular track.

12. A vibration sensing device as recited in claim 1 in which the diameter of the bar where it contacts the annular track is less than its diameter on at least one side of the plate.

13. A vibration sensing device as recited in claim 1 in which the bar has two spaced apart recesses of reduced diameter where it engages the annular tracks.

14. A vibration sensing device as recited in claim 11 in which the vibration sensing device is mounted in a casing which incorporates the base support member, the base support member incorporating a magnetic reed switch, so that the reed switch senses relative movement of an adjacent magnet.

15. A vibration sensing device as recited in claim 1 in which each annular track is formed by a round hole and the bar is a regular sided polygonal in cross-section.

16. A vibration sensing device as recited in claim 1 in which each annular track is formed from a round hole and the bar is a splined shaft.

* * * * *